US009616309B2

(12) United States Patent
Brownstein et al.

(10) Patent No.: US 9,616,309 B2
(45) Date of Patent: Apr. 11, 2017

(54) BASEBALL AND SOFTBALL BAT SWING TRAINING DEVICE

(71) Applicants: Michael A. Brownstein, San Antonio, TX (US); Timothy Edward O'Krongley, San Antonio, TX (US)

(72) Inventors: Michael A. Brownstein, San Antonio, TX (US); Timothy Edward O'Krongley, San Antonio, TX (US)

( * ) Notice: Subject to any disclaimer, the term of this patent is extended or adjusted under 35 U.S.C. 154(b) by 0 days.

(21) Appl. No.: 14/226,359

(22) Filed: Mar. 26, 2014

(65) Prior Publication Data

US 2015/0273302 A1 Oct. 1, 2015

(51) Int. Cl.

| | |
|---|---|
| ***A63B 69/00*** | (2006.01) |
| ***A63B 59/00*** | (2015.01) |
| ***A63B 59/50*** | (2015.01) |
| ***A63B 60/34*** | (2015.01) |
| ***A63B 60/06*** | (2015.01) |
| ***A63B 59/58*** | (2015.01) |
| *A63B 59/55* | (2015.01) |
| *A63B 49/08* | (2015.01) |
| *A63B 53/14* | (2015.01) |
| *A63B 60/22* | (2015.01) |
| *A63B 59/52* | (2015.01) |
| *A63B 102/18* | (2015.01) |

(52) U.S. Cl.

CPC ..... *A63B 69/0002* (2013.01); *A63B 59/50* (2015.10); *A63B 59/58* (2015.10); *A63B 60/06* (2015.10); *A63B 60/34* (2015.10); *A63B 49/08* (2013.01); *A63B 53/14* (2013.01); *A63B 59/52* (2015.10); *A63B 59/55* (2015.10); *A63B 60/22* (2015.10); *A63B 2069/0008* (2013.01); *A63B 2102/18* (2015.10)

(58) Field of Classification Search

CPC . A63B 69/0002; A63B 59/0055; A63B 59/55; A63B 49/08; A63B 53/14; A63B 59/06; A63B 59/05; A63B 59/58; A63B 60/06; A63B 60/34; A63B 59/52; A63B 60/22; A63B 2069/0008; A63B 2102/18

USPC ..... 473/457, 422, 519, 526, 549, 552, 559, 473/564, 568; D21/725–731

See application file for complete search history.

(56) References Cited

U.S. PATENT DOCUMENTS

| | | | | | |
|---|---|---|---|---|---|
| 335,656 | A | * | 2/1886 | Taylor | 473/526 |
| 430,388 | A | * | 6/1890 | Kinst | 473/564 |
| 703,911 | A | * | 7/1902 | Girdwood | 473/526 |
| 838,257 | A | * | 12/1906 | Kinst | 473/564 |
| 2,147,110 | A | * | 2/1939 | Schmid | 473/526 |

(Continued)

*Primary Examiner* — Mitra Aryanpour
(74) *Attorney, Agent, or Firm* — Wayne J. Colton, Inc.

(57) ABSTRACT

A swing training device for improving the batting mechanics of baseball players includes a device handle for gripping by a player in the manner of a baseball bat handle and a device barrel having a ball striking surface. The device barrel is interfaced at an angle from about 20° to about 40° to the device handle. At least the ball striking surface of the device barrel is formed in the size and circular shape of a baseball bat barrel. A joint maybe provided for interfacing the device barrel to the device handle at the desired angle of interface, in which case threaded bolts are utilized to attach the device handle and the device barrel to the joint. Longitudinally oriented threaded bores are provided on substantially planar faces of the device handle and the device barrel to matingly receive the bolts.

4 Claims, 4 Drawing Sheets

(56) References Cited

U.S. PATENT DOCUMENTS

| | | | | | |
|---|---|---|---|---|---|
| D164,883 | S | * | 10/1951 | Schmid | D21/731 |
| 3,767,249 | A | * | 10/1973 | Rogers | 294/49 |
| 4,036,044 | A | | 7/1977 | Yoshimura | |
| 4,038,850 | A | | 8/1977 | Sakagami | |
| 4,103,412 | A | | 8/1978 | Krieger | |
| D263,863 | S | * | 4/1982 | Golab | D21/725 |
| 4,625,965 | A | * | 12/1986 | Mullins | 473/204 |
| 4,659,080 | A | * | 4/1987 | Stoller | 473/526 |
| 5,269,511 | A | * | 12/1993 | Chavez | 473/457 |
| 5,816,958 | A | * | 10/1998 | Seymour | 473/526 |
| 8,272,978 | B2 | | 9/2012 | Windsor | |
| D702,781 | S | * | 4/2014 | Paxson | D21/725 |
| D714,407 | S | * | 9/2014 | Santorelli | D21/725 |
| 2012/0172157 | A1 | * | 7/2012 | McCrory | 473/457 |
| 2013/0184106 | A1 | * | 7/2013 | McCrory | 473/457 |

* cited by examiner

BASEBALL AND SOFTBALL BAT SWING TRAINING DEVICE

FIELD OF THE INVENTION

The present invention relates to baseball and softball training. More particularly, the invention relates to a baseball and softball training device specifically adapted to simultaneously develop a batter's swing mechanics and muscle memory.

BACKGROUND OF THE INVENTION

In order to increase the likelihood for authoritative contact with a pitched baseball or softball, batters are instructed to develop a swing that keeps the barrel of their bat in the hitting zone for as long as possible. Referred to as "staying inside the ball," good swing mechanics requires batters to keep their arms bent at the elbows and their hands in close to their body as the bat is launched knob end first toward the pitched ball with the barrel end lagging behind the hands. Because of the tremendous importance of this skill, and the notorious difficulty with which it is perfected, numerous drills and training aids have been devised to assist batters of all skill levels in learning to consistently lead with their hands as opposed to reaching out front with their bat.

One such training aid is described in U.S. Pat. No. 8,272,978 B2 issued Sep. 25, 2012 to Windsor ("Windsor"). Windsor teaches a training aid, to be used in practice in place of a bat, that comprises a ball striking portion and a handle portion arranged one to the other at an angle from about 5° to about 45°. While this basic arrangement, used as described in Windsor, does result in better hand positioning during practice with the described training aid, the device as taught by Windsor falls short in meeting the ultimate object of the present invention, which is to provide a baseball and softball training device specifically adapted to simultaneously develop a batter's swing mechanics and muscle memory such that the skills as bettered in practice are readily transferred to use in actual play of the game.

In particular, Windsor teaches as a "primary requirement" that the head portion of the training aid must have a substantially planar front (i.e., a flat ball striking surface), regardless of the shape of other portions of the training aid, in order to achieve the stated objective of enabling a batter to determine, without the assistance of an appraising coach, whether or not his or her hands and arms are moving in the proper path. Unfortunately, this of Windsor completely ignores the importance of learning to precisely align the barrel of a bat with the center of the ball while properly controlling the path of the hands and arms.

Additionally, Windsor also fails to fully appreciate the importance of muscle memory in skills training, to with Windsor teaches a device that particularly includes a grip dramatically different than that utilized on any actual baseball or softball bat. As a result, any batter transitioning between the described training aid and an actual bat will most likely lose most if not all of the benefit of training due to the dramatically different overall "feel" presented.

With the foregoing shortcomings of the prior art clearly in mind, it is an overriding object of the present invention to provide a baseball and softball training device specifically adapted to simultaneously develop a batter's swing mechanics and muscle memory such that the skills as bettered in practice are readily transferred to use in actual play of the game. Additionally, it is an object of the present invention to provide such a training device that is also durable in use, such that the provided device may be used at all levels of play from the youngest youth to the seasoned professional. Still further, it is an object of the present invention to provide such a training device that also may be implemented with provision for adapting the device to the particular needs and/or desires of an individual batter. In particular, it is an object of the present invention to provide such a training device that may be implemented with means for selectively interchanging various components to provide highly customizable configurations.

SUMMARY OF THE INVENTION

In accordance with the foregoing objects, the present invention—a swing training device for improving the batting mechanics of baseball players—generally comprises a device handle adapted for gripping by a player in the manner of a baseball bat handle and a device barrel having a ball striking surface. The device barrel is interfaced at an angle to the device handle, which should be from about 20° to about 40°, but most preferably is about 35°. In a critical aspect of the present invention, at least the ball striking surface of the device barrel is formed in the size and circular shape of a baseball bat barrel.

In at least some preferred implementations of the present invention, the swing training device further comprises a joint interfacing the device barrel to the device handle at the desired angle of interface. In the most preferred implementation of this feature, the joint comprises a first threaded bolt for attaching the device handle to the joint and a second threaded bolt for attaching the device barrel to the joint. To this end, the device handle for such an implementation comprises a longitudinally oriented threaded bore centrally disposed on a substantially planar face of the device handle and being sized and otherwise adapted to matingly receive the first threaded bolt. Likewise, the device barrel for such an implementation comprises a longitudinally oriented threaded bore centrally disposed on a substantially planar face of the device barrel and sized and otherwise adapted to matingly receive the second threaded bolt. In any case, in such an implementation the angle of interface between the device barrel and the device handle is defined by the relative orientation of the first and second threaded bolts of the provided joint.

In the most preferred implementations of the present invention, the device handle comprises a knob provided at an end of the device handle opposite the device barrel (or, if provided, the planar face of the device handle). Still further, in the most preferred implementations of the present invention the device barrel, as opposed to only the ball striking surface of the device barrel, is formed in the size and circular shape of a baseball bat barrel.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Although those of ordinary skill in the art will readily recognize many alternative embodiments, especially in light of the illustrations provided herein, this detailed description is exemplary of the preferred embodiment of the present invention, the scope of which is limited only by the claims appended hereto.

EXPRESS DEFINITIONS

Informed by and with the foregoing and following discussions clearly in mind, Applicant now expressly defines the following terms, and variants thereof, wherein the provided definitions are unequivocally intended to prevail over any and all other tenants of construction, including ordinary meaning and implied definition, and shall govern in the construction of the claims drawn hereto as well as in the further understanding of the foregoing and following disclosure:

Baseball. The term "baseball" is expressly defined to refer to and include the sports of softball and wiffle ball, as well as baseball, and similar variants of baseball.

Baseball ball. The term "baseball ball," or simply "ball," is expressly defined to refer to and include any ball permitted by any regulation for use in a baseball (as expressly defined herein) game.

Baseball bat. The term "baseball bat," or simply "bat," is expressly defined to refer to and include any bat permitted by any regulation for use in a baseball (as expressly defined herein) game.

DESCRIPTION

Figures 1, 2, 3:
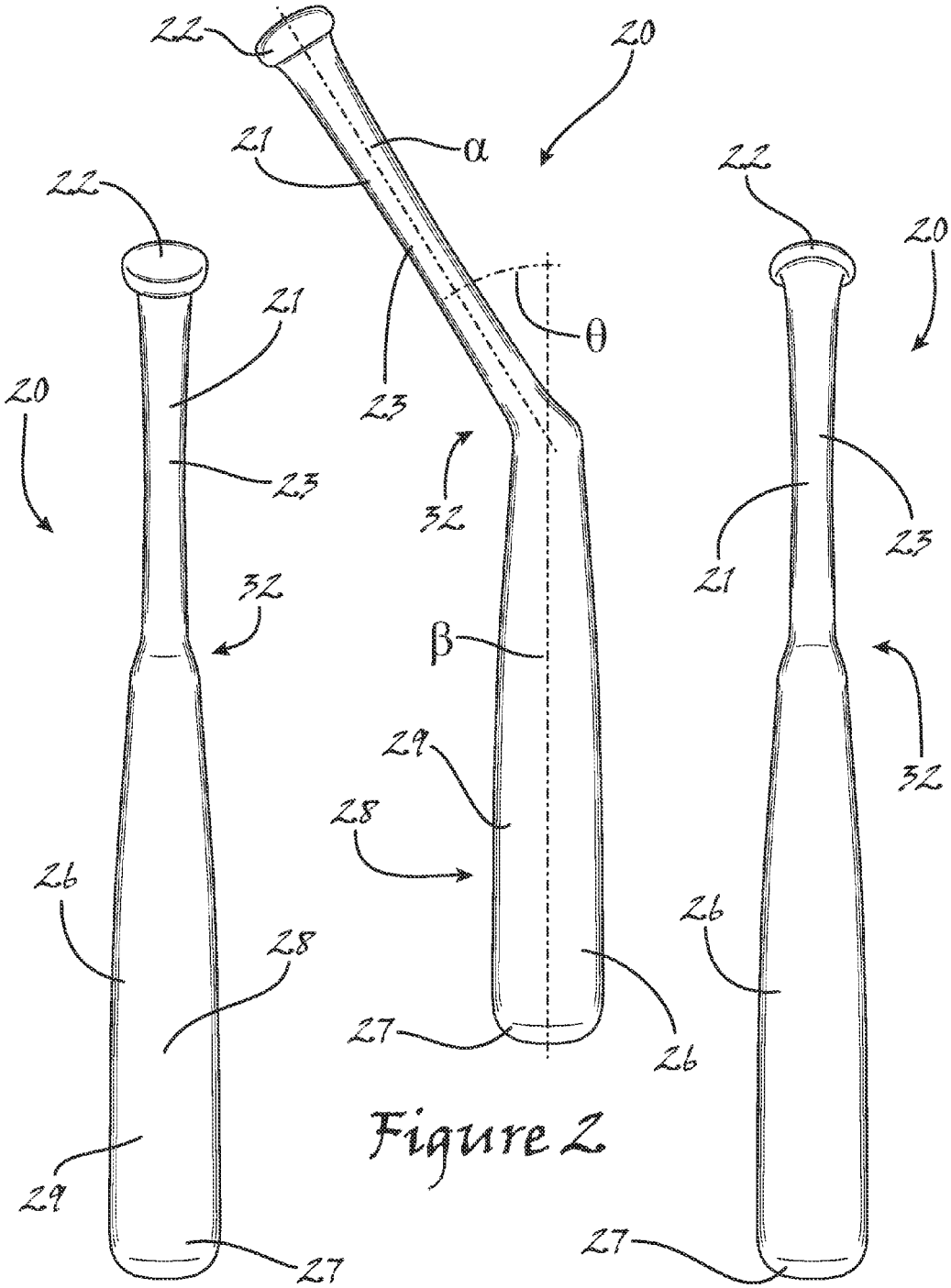
FIG. 1 shows, in a front elevational view, a first preferred implementation of the swing training device of present invention.
FIG. 2 shows, in a right side elevational view, the swing training device of FIG. 1.
FIG. 3 shows, in a rear elevational view, the swing training device of FIG. 1.

Referring now to the figures, and to FIGS. 1 through 3 in particular, a first preferred implementation of the swing training device 20 for improving the batting mechanics of baseball players 42 is shown to generally comprise a device handle 21 adapted for gripping by a player 42 in the manner of a baseball bat handle and a device barrel 26 having a ball striking surface 28 (analogous to the "sweet spot" of a baseball bat barrel). The device barrel 26 is formed unitary with or otherwise connected to the device handle 21 through an angled interface 32, which is formed to produce an interface angle θ of from about 20° to about 40° between the longitudinal axis α through the device handle 21 and the longitudinal axis β through the device barrel 26. In the most preferred embodiments of the present invention, however, Applicant has found it suitable and effective to implement the angled interface 32 such that an interface angle θ of about 35° is provided.

As also depicted in FIGS. 1 through 3, the device handle 21 is most preferably formed in the general size and circular shape of an ordinary regulation baseball bat handle. In this manner, when the player 42 grasps the grip 23 of the handle 21, the swing training device 20 will provide a feel in the hands 43 of the player 42 substantially similar to the feel given by an ordinary baseball bat. As a result, this important feature of the present invention, if implemented, serves to greatly enhance the development of muscle memory in connection with the utilization of the swing training device 20. In furtherance of this end, it is also most preferred that the device handle 21 is provided at its end with a knob 22 of the general size and shape of a conventional knob utilized on an ordinary regulation baseball bat handle.

In a critical aspect of the present invention, however, at least the ball striking surface 28 of the device barrel 26, but most preferably the entire device barrel 26, is formed in the size and circular cross-sectional shape 29 of an ordinary regulation baseball bat barrel. In this manner, the swing training device 20 of the present invention more comprehensively develops the swing mechanics of a training player 42 than does the prior art, which is wholly devoid of means for development of swing accuracy (i.e., alignment of the vertical center of the ball striking surface 28 with the center of the ball 46) in combination with development of proper hand path, such combination being taught only by the present invention.

As will in light of this exemplary discussion be apparent to those of ordinary skill in the art, the swing training device 20 as herein described with respect to FIGS. 1 through 3 may be, and preferably is, manufactured in generally the manner of an ordinary metal baseball bat. As exemplified by U.S. Pat. No. 4,036,044 issued Jul. 19, 1977 to Yoshimura; U.S. Pat. No. 4,038,850 issued Aug. 2, 1977 to Sakagami; and U.S. Pat. No. 4,103,412 issued Aug. 1, 1978 to Krieger, such appropriate manufacturing techniques are readily within the ordinary skill in the art. In any case, the full disclosure of each of U.S. Pat. No. 4,036,044 issued Jul. 19, 1977 to Yoshimura; U.S. Pat. No. 4,038,850 issued Aug. 2, 1977 to Sakagami; and U.S. Pat. No. 4,103,412 issued Aug. 1, 1978 to Krieger is incorporated herein as though now set forth in its respective entirety.

Figure 4:
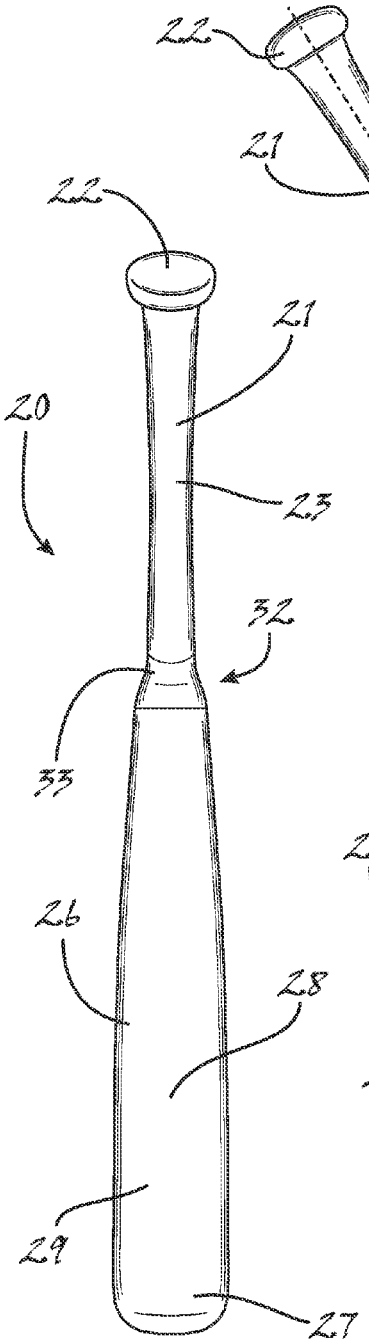
FIG. 4 shows, in a front elevational view, a second preferred implementation of the swing training device of present invention.
Figure 5:
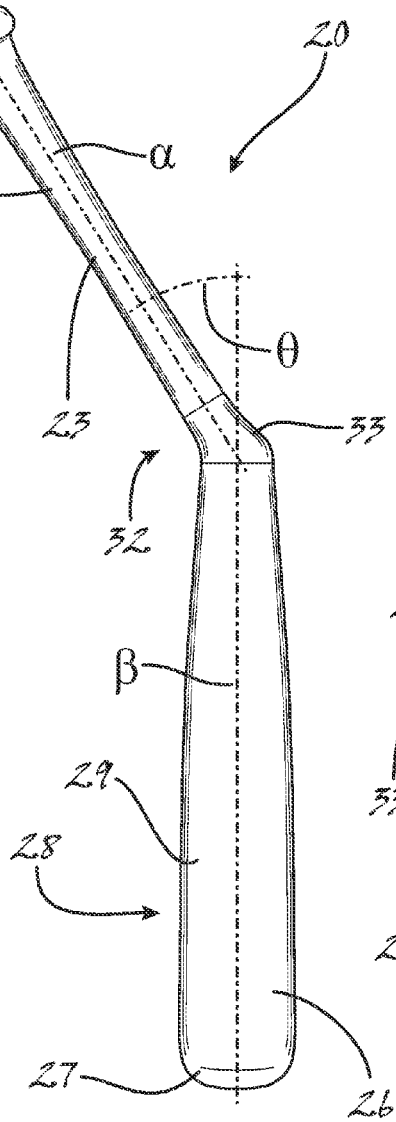
FIG. 5 shows, in a right side elevational view, the swing training device of FIG. 4.
Figure 6:
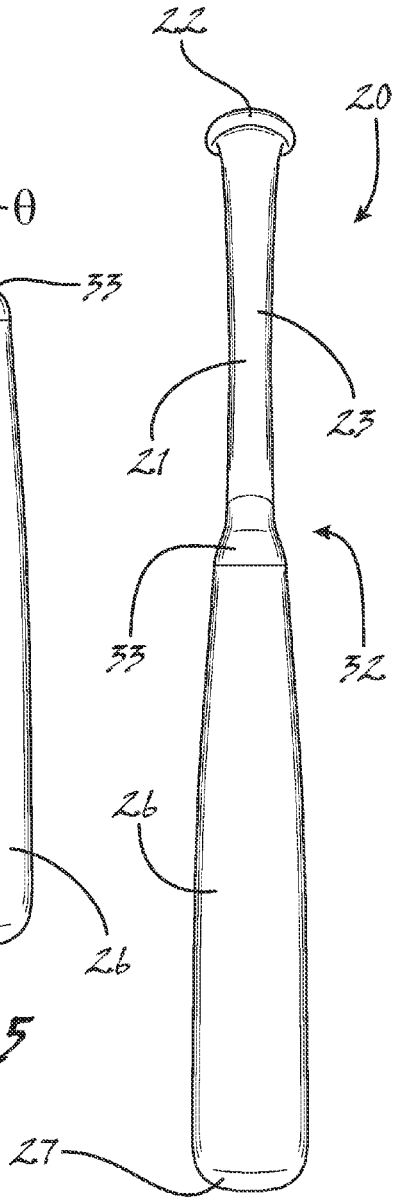
FIG. 6 shows, in a rear elevational view, the swing training device of FIG. 4.
Figure 9:
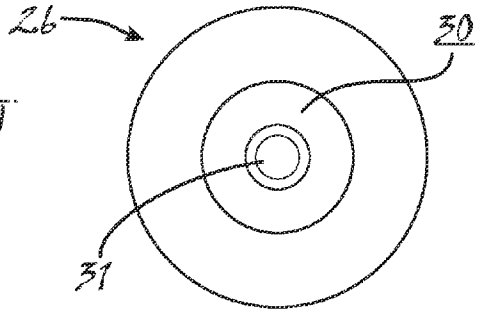
FIG. 9 shows, in an end view, details of a substantially planar surface provided on an end of a device barrel as utilized in the swing training device of FIG. 4.
Figure 7:
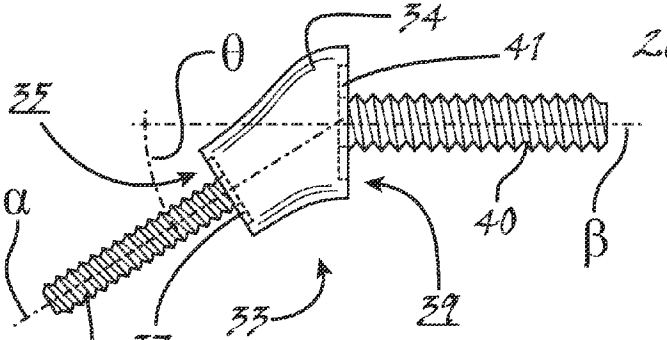
FIG. 7 shows, in a right side view, the preferred implementation of a joint as utilized in the swing training device of FIG. 4.
Figure 8:
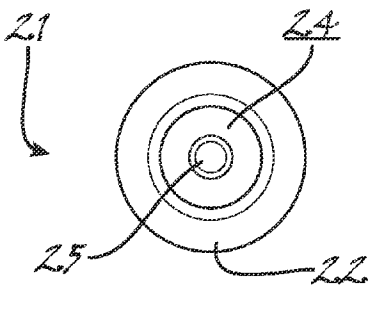
FIG. 8 shows, in an end view, details of a substantially planar surface provided on an end of a device handle as utilized in the swing training device of FIG. 4.
Figure 10:
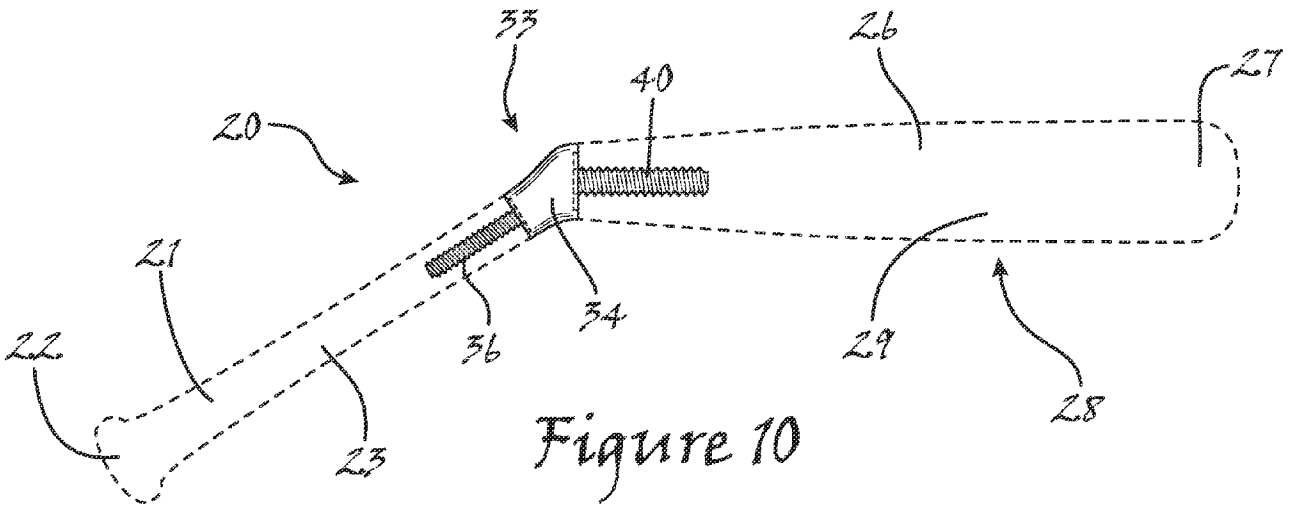
FIG. 10 shows, in a right side view corresponding to the view of FIG. 7, details of the interface of the joint of FIG. 7 with the device handle of FIG. 8 and the device barrel of FIG. 9.

Referring now to FIGS. 4 through 6, an alternatively preferred implementation of the swing training device 20 for improving the batting mechanics of baseball players 42 is shown to generally comprise each of the features of the implementation of FIGS. 1 through 3, but also including a joint 33 interfacing the device barrel 26 to the device handle 21 at the desired interface angle θ. In the most preferred implementation of this feature, as particularly depicted in FIGS. 7 through 10, the joint 33 comprises body 34 having formed or otherwise provided thereon a handle face 35 and a barrel face 39. A first threaded bolt 36 for attaching the device handle 21 to the joint 33 is provided extending from handle face 35. Likewise, a second threaded bolt 40 for attaching the device barrel 26 to the joint 33 is provided extending from barrel face 40.

In order that the device handle 21 may in this implementation be attached to the provided joint 33, the device handle 21 comprises a longitudinally oriented threaded bore 25 centrally disposed on a substantially planar face 24 of the device handle 21 and being sized and otherwise adapted to matingly receive the first threaded bolt 36. Likewise, the device barrel 26 for such an implementation comprises a longitudinally oriented threaded bore 31 centrally disposed on a substantially planar face 30 of the device barrel 26 and sized and otherwise adapted to matingly receive the second threaded bolt 40. In any case, as particularly depicted in FIGS. 7 and 10, it is noted that in this implementation the interface angle θ between the device handle 21 and the device barrel 26 is defined by the relative orientation of the first threaded bolt 36 (which defines the longitudinal axis α through the device handle 21) and the second threaded bolt 40 (which defines the longitudinal axis β through the device barrel 26).

As will in light of this exemplary discussion be apparent to those of ordinary skill in the art, implementation of the swing training device 20 as herein described with respect to FIGS. 4 through 10 provides additional substantial advantages over the prior art. In the first instance, implementation of the joint 33 enables the device handle 21 and/or the device barrel 26 to be manufactured from wood, thereby ensuring that a player 42 may have maximum choice in configuration of the swing training device 20. Likewise, such an implementation enables a player 42 to selectively choose the size, weight, balance and the like for either the device handle 21 or the device barrel 26, thereby ensuring that training more closely approximates actual play, which in turn results in better development of muscle memory.

Figure 11:
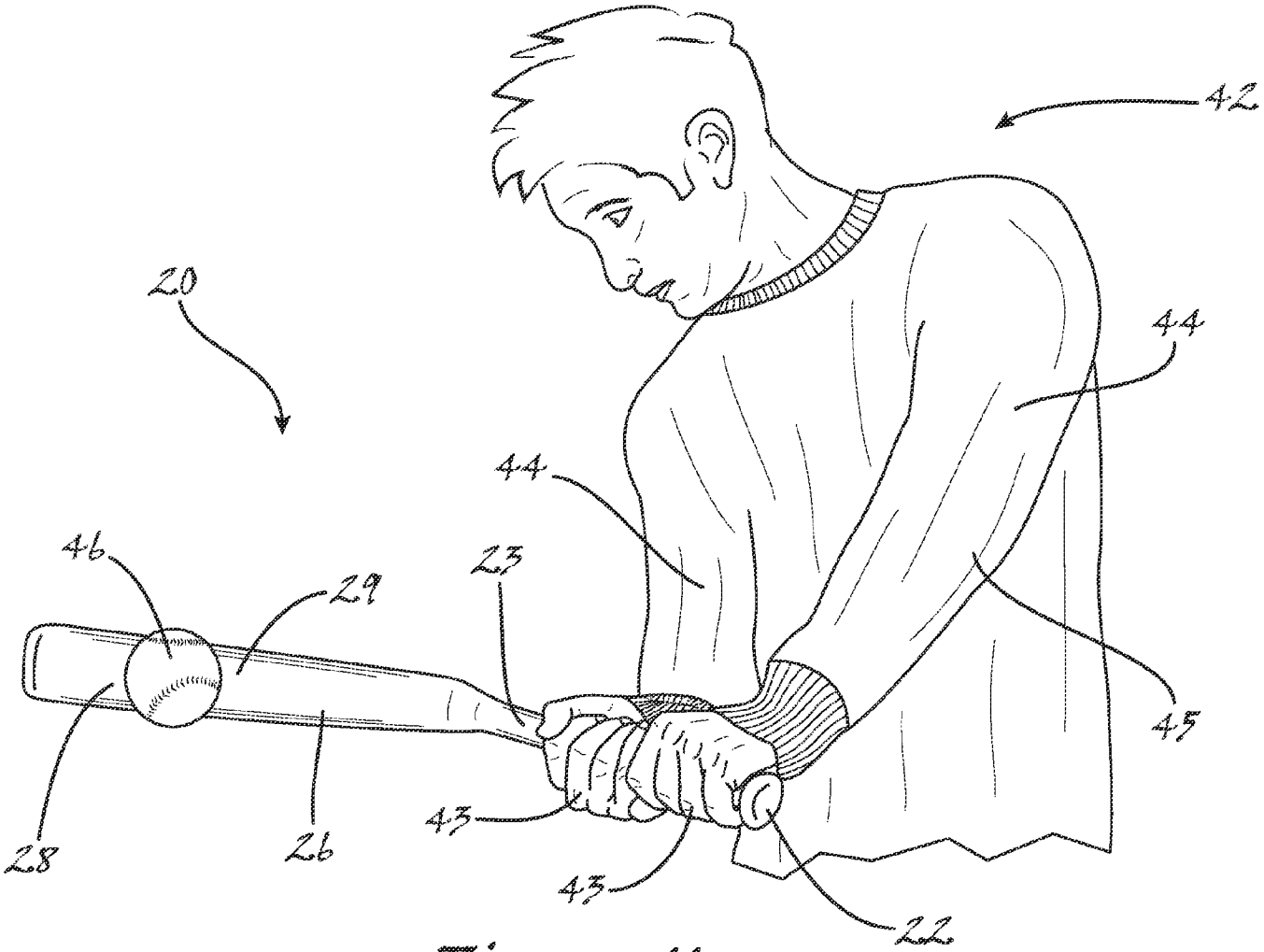
FIG. 11 shows, in a front perspective view, utilization by a batter of the swing training device of either FIG. 1 or FIG. 4.

Referring then to FIG. 11, the swing training device 20 of the present invention is shown as operably employed by a player 42. In particular, it is shown that the swing training device 20 of the present invention is used to teach the player 42 to swing with the hands 43 leading the knob 22 of the swing training device 20 while the end 27 (also referred to as the tip) of the device barrel 26 first trails the hands 43 and then, during the launch phase of the swing, snaps into the hitting zone. As shown in the figure, this training encourages good swing form, to with the hands 43 lead the swing training device 20 while the player's arms 44 remain tight to the player's body with elbows 45 bent, thereby "staying inside the ball 46." Additionally, however, as also depicted in the figure, the critical implementation of the device barrel 26 in the general form of an ordinary regulation baseball bat barrel serves to simultaneously address striking accuracy while provision of the device handle 21 in the general form of an ordinary regulation baseball bat handle further serves to simultaneously ensure maximum development of muscle memory for the improved swing mechanics.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. For example, those of ordinary skill in the art will recognize in light of this exemplary description that an annular recess 37 may be formed in the joint 33 about the first bolt 36 and, likewise, an annular recess 41 may be formed in the joint 33 about the second bolt 40, each provided annular recess 36, 41 thus facilitating use of a lock washer to more securely affix the device handle 21 and the device barrel 26, respectively. In any case, because the scope of the present invention is much broader than any particular embodiment, the foregoing detailed description should not be construed as a limitation of the scope of the present invention, which is limited only by the claims appended hereto.

What is claimed is:

1. A swing training device for improving the batting mechanics of baseball players, said swing training device comprising:

a device handle formed in the size and circular shape of a baseball bat handle and thereby adapted for ordinary, two-handed gripping by a player in the manner of a baseball bat handle;

a device barrel, said device barrel having a ball striking surface;

a joint interfacing said device barrel at an angle to said device handle, said angle being from about 20° to about 40°; and wherein:

said ball striking surface of said device barrel is formed in the size and circular shape of a baseball bat barrel;

said joint comprises a first threaded bolt for attaching said device handle to said joint and a second threaded bolt for attaching said device barrel to said joint;

said device handle comprises a longitudinally oriented threaded bore centrally disposed on a substantially planar face of said device handle, said threaded bore of said device handle being adapted to matingly receive said first threaded bolt;

said device barrel comprises a longitudinally oriented threaded bore centrally disposed on a substantially planar face of said device barrel, said threaded bore of said device barrel being adapted to matingly receive said second threaded bolt; and wherein said angle is defined by the relative orientation of said first threaded bolt and said second threaded bolt.

2. The swing training device as recited in claim 1, wherein said device handle comprises a knob provided at an end of said device handle opposite said planar face of said device handle.

3. The swing training device as recited in claim 1, wherein said angle is about 35°.

4. The swing training device as recited in claim 3 wherein said device handle comprises a knob provided at an end of said device handle opposite said planar face of said device handle.

* * * * *